US007791624B2

(12) United States Patent
Obuchi

(10) Patent No.: US 7,791,624 B2
(45) Date of Patent: Sep. 7, 2010

(54) THERMAL ACTIVATION DEVICE, PRINTER, THERMAL ACTIVATION METHOD, AND METHOD OF PRODUCING A SELF-ADHESIVE LABEL

(75) Inventor: Tatsuya Obuchi, Chiba (JP)

(73) Assignee: Seiko Instruments Inc. (JP)

( * ) Notice: Subject to any disclaimer, the term of this patent is extended or adjusted under 35 U.S.C. 154(b) by 403 days.

(21) Appl. No.: 12/011,379

(22) Filed: Jan. 24, 2008

(65) Prior Publication Data

US 2008/0198217 A1 Aug. 21, 2008

(30) Foreign Application Priority Data

Feb. 14, 2007 (JP) ..... 2007-033146

(51) Int. Cl.
*B41J 2/315* (2006.01)
*B41J 2/32* (2006.01)

(52) U.S. Cl. ..... 347/171; 347/218

(58) Field of Classification Search ..... 347/171, 347/215, 216, 218; 400/120.01, 621
See application file for complete search history.

(56) References Cited

U.S. PATENT DOCUMENTS 6,863,104 B2 * 3/2005 Okayasu et al. ..... 156/351
6,947,066 B2 * 9/2005 Sato et al. ..... 347/217
7,101,100 B2 * 9/2006 Hoshino et al. ..... 400/120.01
7,104,713 B2 * 9/2006 Hoshino et al. ..... 400/621
7,477,275 B2 * 1/2009 Takahashi ..... 347/213
7,579,573 B2 * 8/2009 Kohira et al. ..... 219/388
2007/0252886 A1 * 11/2007 Sambongi et al. ..... 347/171

* cited by examiner

*Primary Examiner*—Huan H Tran
(74) *Attorney, Agent, or Firm*—Adams & Wilks

(57) ABSTRACT

Provided is a thermal activation device capable of preventing a heat-sensitive adhesive sheet from being partially excessively heated, keeping a short distance between a contact between a thermal head and a platen roller, and a discharge port, and preventing a structure of the thermal activation device from being complicated and a size thereof from increasing. While a heat-sensitive adhesive sheet (2) is transported along a transport path (15) through rotations of insertion rollers (3) and a platen roller (5), a heat-generating portion (4*a*) of the thermal head (4) is caused to generate heat, thereby thermally activating a heat-sensitive adhesive layer of the heat-sensitive adhesive sheet (2). When a trailing edge of the heat-sensitive adhesive sheet (2) reaches a position where the trailing edge thereof is not in contact with the platen roller (5), a transporting force is not transmitted to the heat-sensitive adhesive sheet (2), thereby stopping transportation thereof. At that time, an adhesion prevention member (6) is allowed to enter the transport path (15) to lift and hold the trailing edge of the heat-sensitive adhesive sheet (2) to a position where the trailing edge thereof is not in contact with the thermal head (4).

10 Claims, 5 Drawing Sheets

THERMAL ACTIVATION DEVICE, PRINTER, THERMAL ACTIVATION METHOD, AND METHOD OF PRODUCING A SELF-ADHESIVE LABEL

BACKGROUND OF THE INVENTION

1. Field of the Invention

The present invention relates to a thermal activation device for heating and thermally activating a heat-sensitive adhesive sheet so as to develop adhesive properties, a printer including the thermal activation device, a thermal activation method, and to a method of producing a self-adhesive label.

2. Description of the Related Art

Up to now, a heat-sensitive adhesive sheet having a heat-sensitive adhesive layer with adhesive properties to be developed by heat has been put to practical use. The heat-sensitive adhesive sheet has some advantages in that, for example, the heat-sensitive adhesive sheet can be easily treated because the sheet has no adhesive properties before being heated, and industrial waste is not produced because releasing paper is not used. In order to develop an adhesive force of the heat-sensitive adhesive layer of the heat-sensitive adhesive sheet, the heat-sensitive adhesive layer is heated using a thermal head, which is generally used as a recording head of a thermal printer, in some cases. In this case, a platen roller is provided so as to be opposed to the thermal head, and the platen roller is rotated while pressing the heat-sensitive adhesive sheet against the thermal head, thereby transporting the heat-sensitive adhesive sheet. Then, an entire surface or a part of the heat-sensitive adhesive sheet is thermally activated, thereby developing the adhesive force.

In addition, JP 2004-243606 A discloses a printer which includes: a recording device (printing unit) for recording desired characters, numeric characters, graphics, and the like on a surface of a continuous-form heat-sensitive adhesive sheet, which is an opposite side of a heat-sensitive adhesive layer thereof; a cutting device (cutting unit) for cutting the heat-sensitive adhesive sheet; and a thermal activation device (thermal activation unit) including the thermal head and the platen roller. In the printer, the heat-sensitive adhesive sheet, which is subjected to recording on one surface thereof by the recording device, is cut into a predetermined length by the cutting device, and the cut heat-sensitive adhesive sheet with a short length is supplied to the thermal activation device. In the thermal activation device, the cut heat-sensitive adhesive with the short length is transported through rotation of the platen roller, and at the same time, is thermally activated by the thermal head. In other words, a portion of the heat-sensitive adhesive sheet, which has passed through the thermal head, is thermally activated to thereby develop adhesive properties thereof. A self-adhesive label, which is produced by the printer and is formed of the heat-sensitive adhesive sheet, is held in a state where a leading edge thereof protrudes from a discharge port. Then, a user picks up the leading edge thereof protruding from the discharge port, and pulls out the self-adhesive label from the discharge port for use.

As described above, in the thermal activation device, the cut heat-sensitive adhesive sheet is transported through the rotation of the platen roller. To be exact, the heat-sensitive adhesive sheet is transported during a time when a trailing edge thereof is in contact with the platen roller, but when the trailing edge of the heat-sensitive adhesive sheet is apart from the platen roller and reaches a position at which the trailing edge thereof is not in contact with the platen roller, a transporting force is not transmitted to the heat-sensitive adhesive sheet, thereby stopping the transportation of the heat-sensitive adhesion sheet. Then, the heat-sensitive adhesive sheet is held in a stationary state until the user pulls out the heat-sensitive adhesive sheet. In this case, when a part (trailing edge) of the heat-sensitive adhesive sheet is in contact with the thermal head, the heat-sensitive adhesive sheet with adhesive properties being already developed is adhered to the thermal head, and is maintained at high temperature. Even when driving of the thermal head is stopped, a residual heat remains in the thermal head, so the heat-sensitive adhesive sheet is continuously excessively applied with heat without being naturally cooled. As a result, the heat-sensitive adhesive layer of the heat-sensitive adhesive sheet is excessively heated, and the adhesive force of a part of the heat-sensitive adhesive layer is reduced. In addition, in a case where a recordable layer is formed on a surface opposite to the heat-sensitive adhesive layer, heat is excessively transmitted to the recordable layer, which may cause abnormal color development, for example, generation of a black line (stripe line).

In order to avoid the above-mentioned problems, the heat-sensitive adhesive sheet may be held so as not to be in contact with the thermal head. However, the platen roller also has a function of pressing the heat-sensitive adhesive sheet against the thermal head when the thermal activation is performed. Accordingly, a heat-generating portion of the thermal head and a portion thereof for transmitting the transporting force to the heat-sensitive adhesive sheet are generally overlapped each other at substantially the same point. In view of the above, it is difficult to set the trailing edge of the heat-sensitive adhesive sheet to be apart from the heat-generating portion of the thermal head as soon as the trailing edge thereof is apart from the platen roller. If the heat-sensitive adhesive sheet can be transported so as to reach a position where the heat-sensitive adhesive sheet is not in contact with the thermal head, the heat-sensitive adhesive sheet is inevitably positioned within a short distance from the thermal head at which the heat of the head of the thermal head is transmitted to the heat-sensitive adhesive sheet. Accordingly, it is impossible to prevent the heat-sensitive adhesive sheet from being partially excessively heated as described above.

Thus, it is difficult to transport the heat-sensitive adhesive sheet so as to reach the position at which the heat of the thermal head is not transmitted to the heat-sensitive adhesive sheet, only by transporting the heat-sensitive adhesive sheet through rotation of the platen roller. In view of the above, another transporting means may be provided at the downstream side of the platen roller (at a position far from the thermal head). For example, between a contact between the thermal head and the platen roller, and the discharge port, a pair of discharge rollers may be provided so as to sandwich the heat-sensitive adhesive sheet therebetween, thereby transporting the heat-sensitive adhesive sheet to a position apart from the thermal head, at which the heat of the thermal head is not transmitted to the heat-sensitive adhesive sheet. However, in this case, there is a risk that the heat-sensitive adhesive sheet which has developed the adhesive force is adhered to the transport roller and cannot be transported to the discharge port. If a force of the pair of discharge rollers for sandwiching the heat-sensitive adhesive sheet is reduced so that the heat-sensitive adhesive sheet is not adhered to the discharge roller, there is a risk that a sufficient transporting force cannot be transmitted to the heat-sensitive adhesive sheet and the heat-sensitive adhesive sheet cannot be transported to the discharge port after all.

A transporting device other than the pair of discharge rollers, for example, a transporting device including a belt conveyor and a movable suction cup, may be provided between a contact between the thermal head and the platen roller, and the discharge port. However, in this case, it is necessary to provide a complicated and large structure between a contact between the thermal head and the platen roller, and the discharge port, with the result that the structure of the device is complicated and the size thereof is increased, and in addition, costs thereof increase. Further, in order for the user to pull out and use the heat-sensitive adhesive sheet which is cut with a short length and made into labels, it is necessary to hold the heat-sensitive adhesive sheet in a state where the trailing edge thereof protrudes to the outside from the discharge port. Accordingly, the heat-sensitive adhesive sheet with the short length is provided only at a position extremely close to the discharge port. For this reason, it is necessary to additionally provide a structure for holding the heat-sensitive adhesive sheet with the short length, in the vicinity of the discharge port. Further, in a case where the distance between the contact between the thermal head and the platen roller, and the discharge port, becomes longer when the transporting device including the belt conveyor and the suction cup is provided, a distance by which the heat-sensitive adhesive sheet is transported also becomes longer.

SUMMARY OF THE INVENTION

It is an object of the present invention to provide a thermal activation device capable of preventing a heat-sensitive adhesive sheet from being partially excessively heated, keeping a short distance from a contact between a thermal head and a platen roller to a discharge port, and preventing the structure of the thermal activation device from being complicated and the size thereof from increasing, a printer including the thermal activation device, a thermal activation method, and a method of producing a self-adhesive label.

A thermal activation device according to the present invention includes: a thermal head for heating a heat-sensitive adhesive layer of a heat-sensitive adhesive sheet to develop adhesive properties; a platen roller disposed so as to face the thermal head, for transporting the heat-sensitive adhesive sheet; and an adhesion prevention member disposed between a contact between the thermal head and the platen roller, and a discharge port, and capable of advancing and retracting with respect to a transport path for the heat-sensitive adhesive sheet transported by the platen roller.

With the structure, the heat-sensitive adhesive sheet subjected to thermal activation by the thermal head is moved by the adhesion prevention member when the heat-sensitive adhesive sheet is not in contact with the platen roller and when the transporting force is not transmitted to the heat-sensitive adhesive sheet, thereby preventing the heat-sensitive adhesive sheet from being adhered to the thermal head. As a result, the heat-sensitive adhesive sheet is prevented from being excessively heated. In addition, there is no need to provide a particular transporting device between a contact between the thermal head and the platen roller, and the discharge port, and the distance between the contact between the thermal head and the platen roller, and the discharge port becomes shorter, which contributes to downsizing of the device and simplification of the structure thereof.

A thermal activation device according to the present invention preferably includes drive means for causing the adhesion prevention member to advance and retract with respect to the transport path. It is preferable that the drive means include a motor, and the motor be capable of driving the platen roller. Further, in that case, a thermal activation device according to the present invention may further include a one-way clutch for driving the platen roller through rotation of the motor in one direction, and for driving the adhesion prevention member through rotation of the motor in a direction opposite to the one direction.

With the structure, the motor which is conventionally provided for driving the platen roller can be used for driving the adhesion prevention member, thereby simplifying the structure.

A printer according to the present invention includes: a recording device for performing recording on a surface of a heat-sensitive adhesive sheet, which is an opposite side of a heat-sensitive adhesive layer of the heat sensitive adhesive sheet; a cutting device for cutting the heat-sensitive adhesive sheet; and the thermal activation device according to any one of the above descriptions which is positioned at a downstream side of the recording device and of the cutting device.

A thermal activation method according to the present invention includes the steps of: heating a heat-sensitive adhesive layer of a heat-sensitive adhesive sheet by a thermal head positioned so as to be opposed to a platen roller while transporting the heat-sensitive adhesive sheet by the platen roller; and pressing an adhesion prevention member against the heat-sensitive adhesive sheet to move the heat-sensitive adhesive sheet apart from the thermal head, when transmission of a transporting force from the platen roller to the heat-sensitive adhesive sheet is stopped.

A method of producing a self-adhesive label according to the present invention includes the steps of: performing recording on a surface of a continuous-form heat-sensitive adhesive sheet, which is an opposite side of a heat-sensitive adhesive layer of the heat-sensitive adhesive sheet; cutting the heat-sensitive adhesive sheet subjected to recording; and executing the steps of the thermal activation method described above with respect to the cut heat-sensitive adhesive sheet.

According to the present invention, the heat-sensitive adhesive sheet is not partially excessively heated, thereby preventing the adhesive force from being lowered, and the abnormal color development does not occur in a case where the heat-sensitive adhesive sheet has a recordable layer formed on one surface thereof. In addition, the present invention prevents the structure from increasing in size and from being complicated, and prevents costs from increasing.

DETAILED DESCRIPTION OF THE PREFERRED EMBODIMENTS

Hereinafter, embodiments of the present invention will be described with reference to the drawings.

Figure 1:
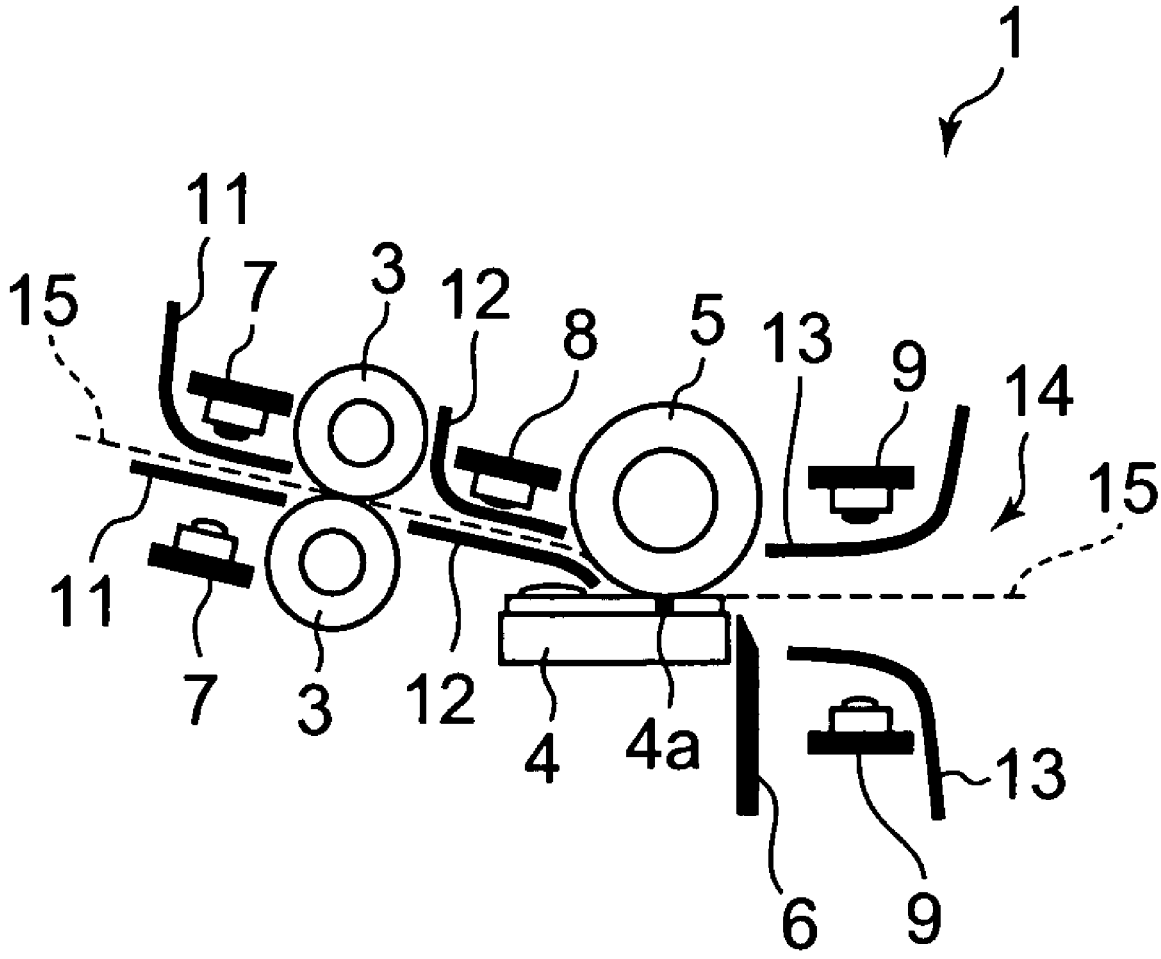
FIG. 1 is a schematic diagram showing a main part of a thermal activation device according to an embodiment of the present invention.

FIG. 1 is a schematic cross-sectional diagram showing a thermal activation device 1 according to an embodiment of the present invention. The thermal activation device 1 includes: a pair of insertion rollers 3 for introducing a heat-sensitive adhesive sheet 2 (see FIG. 4), which is to be subjected to thermal activation, into the thermal activation device 1; a thermal head 4 for heating and thermally activating a heat-sensitive adhesive layer of the heat-sensitive adhesive sheet 2; a platen roller 5 for sandwiching the heat-sensitive adhesive sheet 2 between the platen roller 5 and the thermal head 4; an adhesion prevention member 6 positioned at a downstream side of the thermal head 4; a plurality of sensors 7, 8, and 9; guide members 11, 12, and 13; and a discharge port 14.

Those members will be described in the order from an upstream side in a sheet transport direction. The guide members 11 guide the heat-sensitive adhesive sheet 2 into the thermal activation device 1 from the upstream side, and are disposed at a starting point of a transport path 15 for the heat-sensitive adhesive sheet 2. Further, the sheet insertion detection sensors 7 are provided so as to be adjacent to the guide members 11. The sheet insertion sensors 7 are disposed such that a detection portion thereof faces the transport path 15.

In addition, the pair of the insertion rollers 3 are disposed and a contact between the rollers 3 forms a part of the transport path 15. One of the pair of insertion rollers 3 may be a drive roller, and the other thereof may be a driven roller. At a downstream side of the pair of insertion rollers 3, there are provided the guide members 12 for retaining the transport path 15 to guide the heat-sensitive adhesive sheet 2 to the platen roller 5, and the sheet detection sensor 8 adjacent to the guide members 12. The sheet detection sensor 8 is disposed such that a detection portion thereof faces the transport path 15.

At a position to which the heat-sensitive adhesive sheet 2 is guided by the guide members 12, there are provided the thermal head 4 and the platen roller 5. The thermal head 4 may have a structure similar to that of a recording head used for a typical thermal printer. For example, the thermal head may have a structure in which a plurality of heat-generating elements, each of which is formed of a small resistor, are arranged in a width direction (vertical direction of FIG. 1). FIG. 1 shows a heat-generating portion 4*a* having the heat-generating elements arranged therein. The platen roller 5 is disposed so as to face the thermal head 4, and the heat-sensitive adhesive sheet 2 on the transport path 15 is sandwiched between the thermal head 4 and the platen roller 5. Accordingly, the platen roller 5 brings the heat-sensitive adhesive sheet 2 into press contact with the heat-generating portion 4*a* of the thermal head 4 to support the heat sensitive adhesive sheet 2. Further, the platen roller 5 functions as a base for performing excellent thermal activation, and rotates to transport the heat-sensitive adhesive sheet 2.

At the downstream side in the vicinity of the thermal head 4, the adhesion prevention member 6 is provided. The adhesion prevention member 6 has a bar-like shape that extends in the width direction of the thermal head 4, and a leading end thereof is tapered. The adhesion prevention member 6 can be moved between a position at which the adhesion prevention member 6 is apart from the transport path 15 for the heat-sensitive adhesive sheet 2 as shown in FIG. 1, and a position at which the adhesion prevention member 6 enters the transport path 15 for the heat-sensitive adhesive sheet 2 as shown in FIG. 4E. Though not shown in FIG. 1, an adhesion prevention member detection sensor 10 (see FIG. 2) for detecting the position of the adhesion prevention member 6 is provided so as to be adjacent to the adhesion prevention member 6.

The guide members 13 and the discharge port 14 are formed by bending inward opposed portions of a frame which is partially illustrated. In the vicinity of the discharge port 14, the sheet removal detection sensors 9 are provided.

Figure 2:
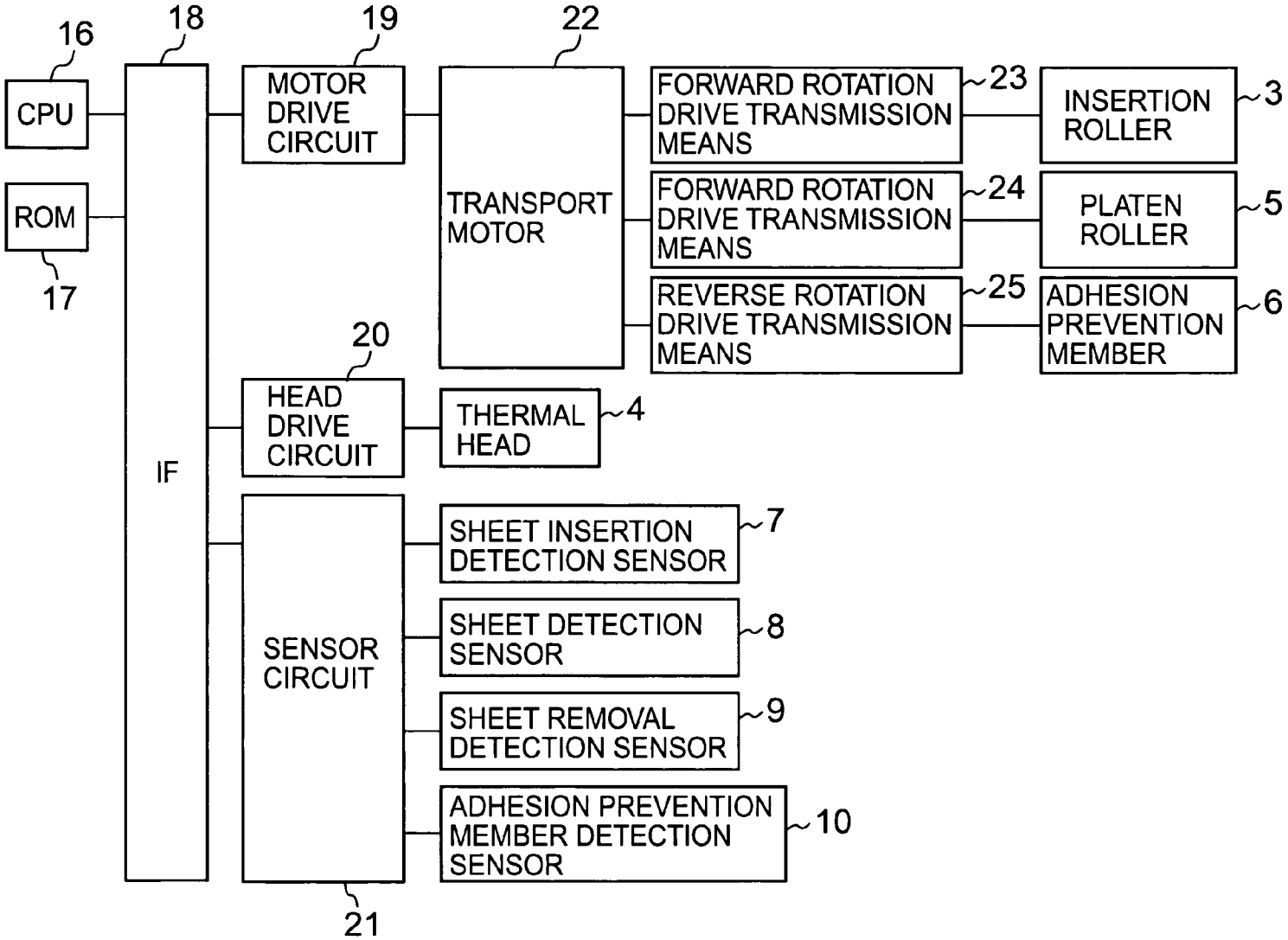
FIG. 2 is a block diagram of the thermal activation device of FIG. 1.

FIG. 2 is a block diagram showing a drive mechanism for driving those members of the thermal activation device. A central processing unit (CPU) 16 controls the overall operations of the thermal activation device 1 while referring to various data stored in a read-only memory (ROM) 17. The CPU 16 and the ROM 17 are connected to each of a motor drive circuit 19, a head drive circuit 20, and a sensor circuit 21 via an interface (IF) 18. The motor drive circuit 19 is connected to a transport motor 22, the head drive circuit 20 is connected to the thermal head 4, and the sensor circuit 21 is connected to each of four sensors 7, 8, 9, and 10. The transport motor 22 according to the embodiment is connected to the pair of insertion rollers 3 and the platen roller 5 via forward rotation drive transmission means 23 and 24, respectively, and is connected to the adhesion prevention member 6 via a reverse rotation drive transmission means 25. In other words, in the embodiment, movement of the heat-sensitive adhesive sheet 2 along the transport path 15, and advance and retraction of the adhesion prevention member 6 with respect to the transport path 15 are performed using one transport motor 22. Note that the forward rotation drive transmission means 23 and 24 and the reverse rotation drive transmission means 25 may be constituted by a gear train or the like and each include a one-way clutch. Accordingly, when the transport motor 22 rotates in a forward direction, the reverse rotation drive transmission means 25 transmits no force, and does not cause the adhesion prevention member 6 to move. When the transport motor reversely rotates, the forward rotation drive transmission means 23 and 24 transmit no force, and do not cause the insertion rollers 3 and the platen roller 5 to rotate. The drive means for driving the adhesion prevention member, which include the transport motor 22 and the reverse rotation drive transmission means 25, are constituted in the above-mentioned manner.

Figure 3:
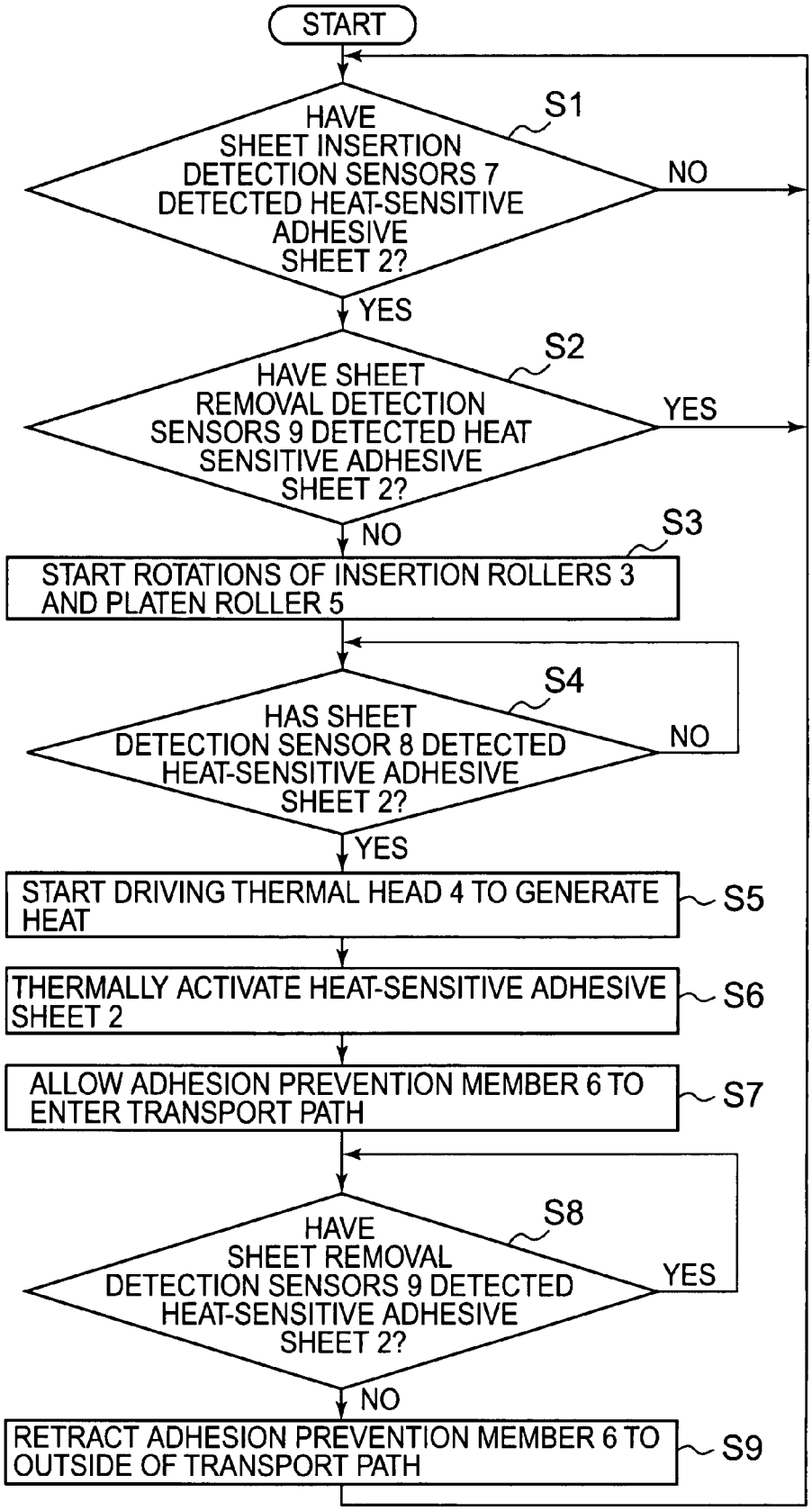
FIG. 3 is a flowchart showing a thermal activation method using the thermal activation device of FIG. 1.

Description is given of a thermal activation method using the thermal activation device described above, with reference a flowchart of FIG. 3 and process diagrams of FIGS. 4A to 4E.

Figure 4A:
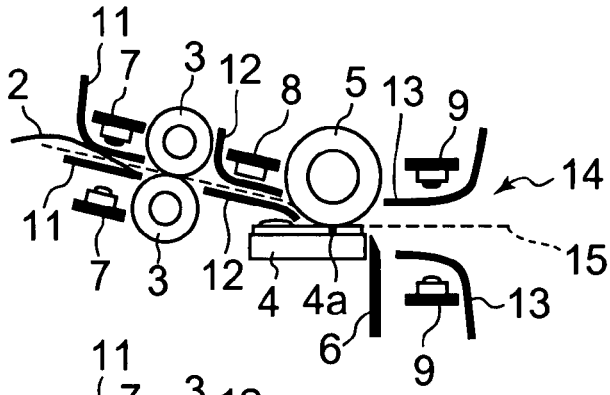
FIGS. 4A to 4E are schematic diagrams each illustrating the thermal activation method shown in FIG. 3 in order of steps.
Figure 4B:
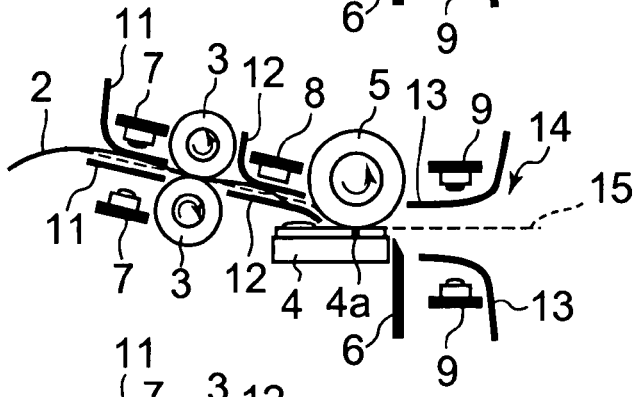
Figure 4C:
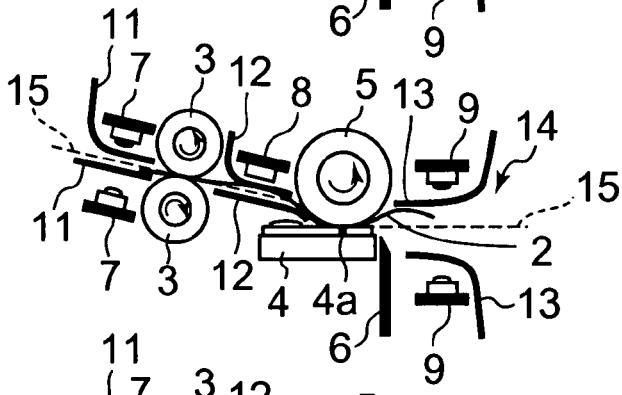

First, when the sheet insertion detection sensors 7 detect that the heat-sensitive adhesive sheet 2 is present at the position in the guide members 11 as shown in FIG. 4A (Step S1), the sheet removal detection sensors 9 detect that the heat-sensitive adhesive sheet 2, which is not yet pulled out by a user and remains in the vicinity of the discharge port 14, is not present (Step S2). When the sheet removal detection sensors 9 detect that the heat-sensitive adhesive sheet 2 is not present, as shown in FIG. 4B, the CPU 16 causes the transport motor 22 to rotate in the forward direction via the IF 18 and the motor drive circuit 19, thereby starting rotations of the insertion rollers 3 and the platen roller 5 via the forward rotation drive transmission means 23 and 24 (Step S3). As a result, the heat-sensitive adhesive sheet 2 is allowed to enter the guide members 12 through the insertion rollers 3 from the guide members 11. When the sheet detection sensor 8 detects the heat-sensitive adhesive sheet 2 provided in the guide members 12 (Step S4), the CPU drives the thermal head 4 via the IF 18 and the head drive circuit 20, thereby starting heat generation of the heat-generating portion 4*a* of the thermal head 4 (Step S5). The insertion rollers 3 and the platen roller 5 continuously rotate from Step S3, so the heat-sensitive adhesive sheet 2 passes through between the thermal head 4 and the platen roller 5 from the guide members 12, as shown in FIG. 4C. At that time, the heat-sensitive adhesive layer thereof is heated and subjected to thermal activation (Step S6).

Figure 4D:
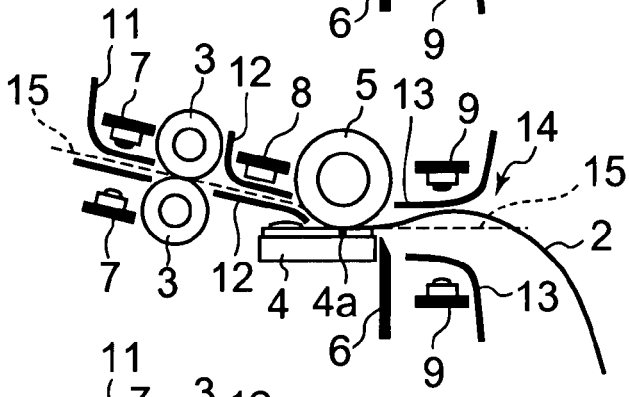
Figure 4E:
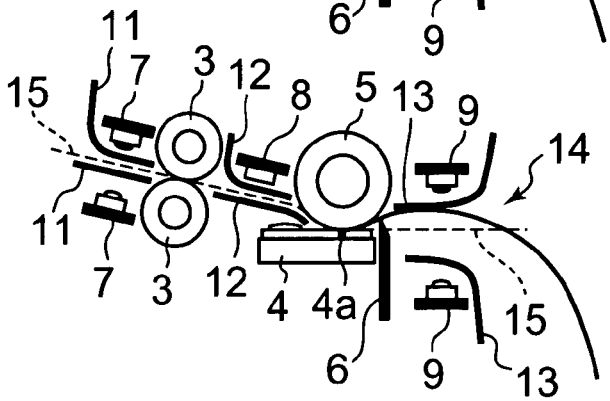

As shown in FIG. 4D, when a trailing edge of the heat-sensitive adhesive sheet 2 subjected to thermal activation passes through between the platen roller 5 and the thermal head 4 and when the heat-sensitive adhesive sheet 2 is not sandwiched between the platen roller 5 and the thermal head 4, a transporting force is not transmitted to the heat-sensitive adhesive sheet 2, thereby stopping transportation of the heat-sensitive adhesive sheet 2. In this case, the heat-sensitive adhesive sheet 2 is in contact with the thermal head 4. If the heat-sensitive adhesive sheet 2 remains in contact with the thermal head 4, there is a fear that the heat-sensitive adhesive sheet 2 with adhesive properties being developed is adhered to the thermal head 4 and is continuously heated. For this reason, the CPU 16 causes the transport motor 22 to reversely rotate via the IF 18 and the motor drive circuit 19, thereby moving the adhesion prevention member 6 via the reverse rotation drive transmission means 25. As a result, the adhesion prevention member 6 is allowed to enter the transport path 15 as shown in FIG. 4E from the position at which the adhesion prevention member 6 is apart from the transport path 15 as shown in FIGS. 4A to 4D, whereby the adhesion prevention member 6 is brought into contact with the trailing edge of the heat-sensitive adhesive sheet 2 and lifts the trailing edge thereof to a position where the heat-sensitive adhesive sheet 2 is not in contact with the thermal head 4 (Step S7).

Note that a timing for completing the thermal activation for the heat-sensitive adhesive sheet 2, that is, a timing when the trailing edge of the heat-sensitive adhesive sheet 2 passes through between the platen roller 5 and the thermal head 4, is obtained based on a rotational speed of the platen roller 5, and a timing for staring rotations of the insertion rollers 3 and the platen roller 5 (timing for starting forward rotation of transport motor 22), or a timing for detecting the heat-sensitive adhesive sheet 2 by the sheet detection sensor 8. Accordingly, a timing for allowing the adhesion prevention member 6 to enter the transport path 15 to lift the trailing edge of the heat-sensitive adhesive sheet 2 can be set in advance. Prior to or simultaneously with the movement of the adhesion prevention member 6, transmission of a drive force to each of the thermal head 4, the insertion rollers 3, and the platen roller 5 is stopped. The rotation of each of the insertion rollers 3 and the platen roller 5 is stopped at the latest when the transport motor 22 starts to reversely rotate.

As shown in FIG. 4E, the heat-sensitive adhesive sheet 2, with the trailing edge being lifted by the adhesion prevention member 6 and with adhesive properties being developed, is held in a stationary state. Until the user pulls out the heat-sensitive adhesive sheet 2 from the discharge port 14, the heat-sensitive adhesive sheet 2 is detected (Step S8), and an operation of the thermal activation for the subsequent heat-sensitive adhesive sheet 2 is not performed. Note that the subsequent heat-sensitive adhesive sheet 2 can be preset in the guide members 11.

When the user pulls out the heat-sensitive adhesive sheet 2 from the discharge port 14, it is detected in Step S8 that the heat-sensitive adhesive sheet 2 is not present. Then, the adhesion prevention member 6 is moved from the position at which the adhesion prevention member 6 is allowed to enter the transport path 15 (see FIG. 4E) to the position at which the adhesion prevention member 6 retracts downward from the transport path 15 (see FIGS. 4A to 4D) (Step S9). After that, the process returns to Step S1, and thermal activation for the subsequent heat-sensitive adhesive sheet 2 is performed.

Note that, though not specifically described, the reverse rotation drive transmission means 25 preferably has a structure in which the adhesion prevention member 6 is allowed to repeatedly ascend and descend in association with the reverse rotation of the transport motor 22. With this structure, in Step S7, at a time point when the transport motor 22 is reversely rotated to some extent so as to allow the adhesion prevention member 6 to ascend, the transport motor 22 is stopped, and in Step S9, the transport motor 22 is further reversely rotated so as to allow the adhesion prevention member 6 to descend, whereby the transport motor 22 can be stopped. Thus, through the rotation of the transport motor 22 only in one direction (backward direction), the adhesion prevention member 6 can be disposed at an ascending position or at a descending position. Accordingly, it is unnecessary to change the rotation direction of the transport motor 22, and thus, the insertion rollers 3 and the platen roller 5 are not affected. In addition, the position of the adhesion prevention member 6 is detected at an appropriate timing by using the adhesion prevention member detection sensor 10, thereby preventing erroneous operation control.

As described above, according to the embodiment, the heat-sensitive adhesive sheet 2, which is subjected to thermal activation to develop the adhesive properties, is lifted by the adhesion prevention member 6 and is held at the position apart from the thermal head 4. Accordingly, the heat-sensitive adhesive sheet 2 is prevented from being adhered to the thermal head 4 and is prevented from being continuously excessively heated. Unlike the conventional case, it is possible to prevent an adhesive force of the heat-sensitive adhesive sheet 2 from being reduced, and it is possible to prevent abnormal color development from occurring when the heat-sensitive adhesive sheet 2 has a recordable layer formed thereon. Note that it is preferable to set a movement amount of the adhesion prevention member 6 to about an amount which is enough to lift the heat-sensitive adhesive sheet 2 to be apart from the thermal head so that the heat of the thermal head 4 is hardly transmitted thereto.

Note that if the positional relationship between the thermal head 4 and the platen roller 5 is set such that the thermal head 4 is disposed above the platen roller 5, it is expected that the heat-sensitive adhesive sheet 2 is to be positioned on the platen roller 5 side by gravitation and is to be apart from the thermal head 4. However, in this case, there are many inconveniences in that, for example, it is difficult for the user to treat the heat-sensitive adhesive sheet 2 from above because the heat-sensitive adhesive sheet 2 is discharged facing upward, and in that characters, symbols, graphics, and the like, which are generally recorded on an opposite side of the adhesive layer in many cases, cannot be seen from above by the user. When a structure for reversing the heat-sensitive adhesive sheet 2 upside down is employed, the structure of the device is complicated and the size of the device is increased. As described above, there arise practical problems when the thermal head 4 is disposed above the platen roller 5.

On the other hand, according to the embodiment, only by additionally providing the adhesion prevention member 6 and the reverse rotation drive transmission means 25, it is possible to prevent the heat-sensitive adhesive sheet 2 from being excessively heated as described above. Further, there occurs no inconvenience when the heat-sensitive adhesive sheet 2 is pulled out from the discharge port 14. In addition, a distance from a contact between the thermal head 4 and the platen roller 5 to the discharge port 14 can be kept short, thereby preventing the size of the device from increasing. In particular, the adhesion prevention member 6 is driven by using the transport motor 22 for driving the insertion rollers 3 and the platen roller 5, thereby preventing the structure of the device from being complicated.

A material to which the heat-sensitive adhesive sheet 2 is not adhered is selected as a material of the adhesion prevention member 6, and the adhesion prevention member 6 is subjected to surface treatment. In addition, the leading end of the adhesion prevention member 6 is tapered and has a small area of contact with the heat-sensitive adhesive sheet 2. Note that the shape of the adhesion prevention member 6 is not limited to the bar-like shape, but may be, for example, a rod shape for lifting the heat-sensitive adhesive sheet 2 at a pinpoint position thereof, and a plate shape which has a large area of contact with the heat-sensitive adhesive sheet 2 and which is highly reliable in holding the heat-sensitive adhesive sheet 2.

Holding means (not shown) for holding the heat-sensitive adhesive sheet 2 may be provided between the adhesion prevention member 6 and the discharge port 14, if necessary. The holding means may be a roller positioned below the transport path 15. The roller may be rotated so as not to be damaged when the leading edge of the heat-sensitive adhesive sheet 2 is brought into contact with the roller, and it is unnecessary for the roller to transmit the transporting force to the heat-sensitive adhesive sheet 2.

Figure 5:
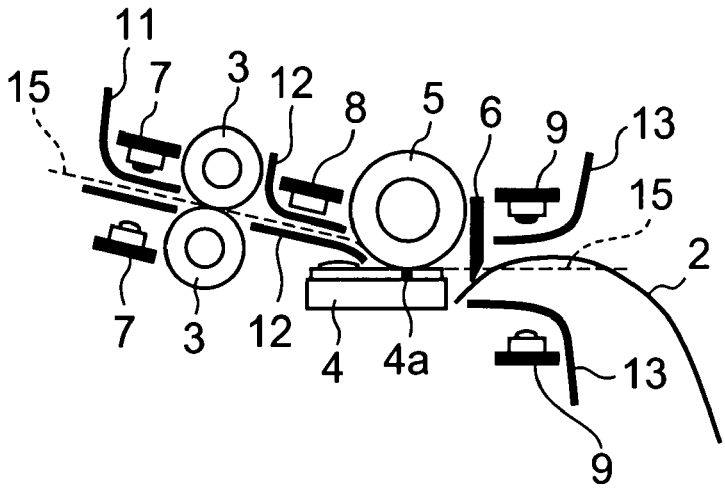
FIG. 5 is a schematic diagram of a thermal activation device according to another embodiment of the present invention.

FIG. 5 shows a thermal activation device according to another embodiment of the present invention. In this embodiment, the adhesion prevention member 6 is positioned above the transport path 15 for the heat-sensitive adhesive sheet 2, and is allowed to descend so as to enter the transport path 15, thereby making it possible to press down the trailing edge of the heat-sensitive adhesive sheet 2 to a position below the thermal head 4. Also in this case, substantially the same effects as described above can be obtained. Whether the adhesion prevention member 6 is provided below or above the transport path 15 is determined in accordance with the layout of various components provided in the device.

Figure 6:
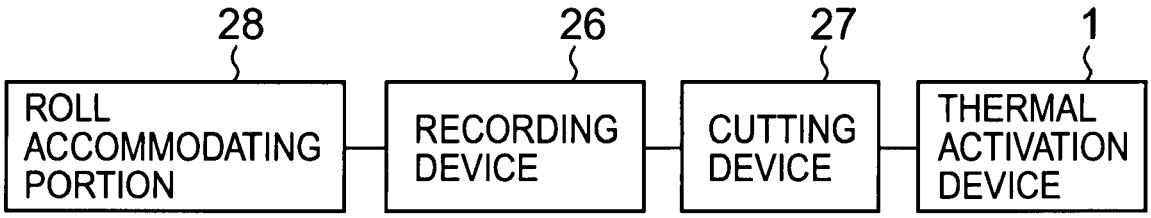
FIG. 6 is a block diagram of a printer according to the present invention.

FIG. 6 briefly shows a structure of a printer including the thermal activation device 1 according to the present invention. The printer has a structure in which a roll accommodating portion 28, a recording device 26, a cutting device 27, and the thermal activation device 1 are arranged in a row in the stated order. The thermal activation device 1 of the printer has the same structure as that described above, and the other structures may be substantially the same as those of the conventional case. Accordingly, explanation thereof is simplified.

The roll accommodating portion 28 (not shown) rotatably holds a roll formed of a continuous-form heat-sensitive adhesive sheet 2 wound into a roll, and subsequently feeds the heat-sensitive adhesive sheet 2 from the roll and supplies the heat-sensitive adhesive sheet 2 to the recording device 26 provided at the downstream side.

The recording device 26 (not shown) includes a thermal head and a platen roller in the same manner as in the thermal activation device 1. The thermal head appropriately heats a recordable layer (heat-sensitive coloring layer), which is provided on an opposite side of the heat-sensitive adhesive layer of the heat-sensitive adhesive sheet, to thereby record desired characters, symbols, graphics, and the like thereon. The platen roller brings the heat-sensitive adhesive sheet into press contact with the thermal head, and is rotated to transport the heat-sensitive adhesive sheet. The thermal head and the platen roller of the recording device may have exactly the same structures as those of the thermal head 4 and the platen roller 5 of the thermal activation device 1. Note that, in contrast to the thermal activation device 1, the thermal head is positioned above the platen roller, which makes it possible to heat the recordable layer formed on the opposite side of the heat-sensitive adhesive layer of the heat-sensitive adhesive sheet 2.

The cutting device 27 (not shown) has a fixed blade and a movable blade which are opposed to each other in the vertical direction through the transport path for the heat-sensitive adhesive sheet 2. The cutting device 27 cuts the continuous-form heat-sensitive adhesive sheet 2 at predetermined positions thereof to obtain single cut sheets (labels).

The printer facilitates production of a self-adhesive label which is formed of the heat-sensitive adhesive sheet 2, has one surface to be desirably recorded, and which has adhesive properties developed on the other surface.

What is claimed is:

1. A thermal activation device, comprising:

a thermal head for heating a heat-sensitive adhesive layer of a heat-sensitive adhesive sheet to develop adhesive properties;

a platen roller disposed so as to face the thermal head, for transporting the heat-sensitive adhesive sheet; and an adhesion prevention member disposed between a contact between the thermal head and the platen roller, and a discharge port, and capable of advancing and retracting with respect to a transport path for the heat-sensitive adhesive sheet transported by the platen roller.

2. A thermal activation device according to claim 1, further comprising drive means for causing the adhesion prevention member to advance and retract with respect to the transport path.

3. A thermal activation device according to claim 2, wherein:

the drive means comprises a motor; and the motor is capable of driving the platen roller.

4. A thermal activation device according to claim 3, further comprising a one-way clutch for driving the platen roller through rotation of the motor in one direction, and for driving the adhesion prevention member through rotation of the motor in a direction opposite to the one direction.

5. A printer, comprising:

a recording device for performing recording on a surface of a heat-sensitive adhesive sheet, which is an opposite side of a heat-sensitive adhesive layer of the heat sensitive adhesive sheet; and a cutting device for cutting the heat-sensitive adhesive sheet, wherein the thermal activation device according to claim 1 is positioned at a downstream side of the recording device and of the cutting device.

6. A printer, comprising:

a recording device for performing recording on a surface of a heat-sensitive adhesive sheet, which is an opposite side of a heat-sensitive adhesive layer of the heat sensitive adhesive sheet; and a cutting device for cutting the heat-sensitive adhesive sheet, wherein the thermal activation device according to claim 2 is positioned at a downstream side of the recording device and of the cutting device.

7. A printer, comprising:

a recording device for performing recording on a surface of a heat-sensitive adhesive sheet, which is an opposite side of a heat-sensitive adhesive layer of the heat sensitive adhesive sheet; and a cutting device for cutting the heat-sensitive adhesive sheet, wherein the thermal activation device according to claim 3 is positioned at a downstream side of the recording device and of the cutting device.

8. A printer, comprising:

a recording device for performing recording on a surface of a heat-sensitive adhesive sheet, which is an opposite side of a heat-sensitive adhesive layer of the heat sensitive adhesive sheet; and a cutting device for cutting the heat-sensitive adhesive sheet, wherein the thermal activation device according to claim 4 is positioned at a downstream side of the recording device and of the cutting device.

9. A thermal activation method, comprising the steps of:

heating a heat-sensitive adhesive layer of a heat-sensitive adhesive sheet by a thermal head positioned so as to be opposed to a platen roller while transporting the heat-sensitive adhesive sheet by the platen roller; and pressing an adhesion prevention member against the heat-sensitive adhesive sheet to move the heat-sensitive adhesive sheet apart from the thermal head, when transmission of a transporting force from the platen roller to the heat-sensitive adhesive sheet is stopped.

10. A method of producing a self-adhesive label, comprising the steps of:

performing recording on a surface of a continuous-form heat-sensitive adhesive sheet, which is an opposite side of a heat-sensitive adhesive layer of the heat-sensitive adhesive sheet;

cutting the heat-sensitive adhesive sheet subjected to recording; and executing the steps of the thermal activation method according to claim 9 with respect to the cut heat-sensitive adhesive sheet.

* * * * *